US006786263B1

(12) United States Patent
Fox, Jr. et al.

(10) Patent No.: US 6,786,263 B1
(45) Date of Patent: Sep. 7, 2004

(54) APPARATUS FOR PRINTING AND APPLYING LABELS

(75) Inventors: Richard P. Fox, Jr., North Huntingdon, PA (US); Richard H. Hoffman, Pittsburgh, PA (US); David J. Malarik, Worthington, PA (US)

(73) Assignee: Fox IV Technologies, Inc., Export, PA (US)

( * ) Notice: Subject to any disclaimer, the term of this patent is extended or adjusted under 35 U.S.C. 154(b) by 82 days.

(21) Appl. No.: 09/948,883

(22) Filed: Sep. 7, 2001

(51) Int. Cl.[7] ..... B65C 9/08; B65C 11/02

(52) U.S. Cl. ..... 156/384; 156/387; 156/541; 156/542; 156/556; 156/564; 156/566

(58) Field of Search ..... 156/384, 387, 156/390, 540, 541, 542, 556, 564, 566, 569

(56) References Cited

U.S. PATENT DOCUMENTS 4,068,028 A * 1/1978 Samonides ..... 156/384
5,431,763 A * 7/1995 Bradshaw ..... 156/256
5,660,663 A * 8/1997 Chamberlain et al. ..... 156/152
5,730,816 A * 3/1998 Murphy ..... 156/64
5,741,381 A * 4/1998 Dolence et al. ..... 156/64
5,885,406 A * 3/1999 Tiefel ..... 156/542
5,897,741 A * 4/1999 Mills et al. ..... 156/541
5,972,155 A * 10/1999 Cooprider et al. ..... 156/269

* cited by examiner

*Primary Examiner*—Sue A. Purvis
(74) *Attorney, Agent, or Firm*—Cohen & Grigsby, P.C.

(57) ABSTRACT

An apparatus is provided for printing data onto one or two surfaces of labels and applying labels to various items. It includes a mounting means for rotatably mounting a roll of label stock, and a transfer means for positioning the inner surface of a label adjacent to at least one print means from the roll and to a separation edge where the label is separated from a next label. The apparatus also includes an applicator for accepting the label from the separation edge and applying the label to an item.

10 Claims, 3 Drawing Sheets

APPARATUS FOR PRINTING AND APPLYING LABELS

FIELD OF THE INVENTION

The present invention relates to an apparatus for printing and applying shipping and packing slip labels to various items and, more particularly, to an efficient continuous feed high speed apparatus for printing two-sided labels and applying them to the item such that the packing slip information is hidden from view.

BACKGROUND OF THE INVENTION

Packaging label printing is typically done either on table top or portable printing equipment or in production using an automatic label printer-applicator. Typically, a table top printer requires the label to be manually placed onto the product. The automatic label printer applicator eliminates the manual label application by printing and automatically applying the label in-line during production or in an off-line station. These, of course, cost more than the table top, but eliminate the manual application, provide consistent label placement, and increase production rates.

Either type of equipment can print roll fed labels using various printing methods such as dot-matrix, laser, thermal direct or thermal transfer printing methods. Laser printing is probably the most familiar method to most people. Labels are fed through the office laser printer in sheets and require hand labeling of the product. An entire sheet is used in the process, even if all that is required is one or two labels. Label materials must be compatible with laser imaging and can get adhesive in the equipment if one is not careful.

Present day automatic label printer applicator machines print the data on the outersurface only of a label, generally a bar code, or destination or "ship to" data. The inner surface contains an adhesive to affix the label to the package. Additional packaging data such as the item contents or invoice must be provided separately typically either enclosed in an envelope or pouch affixed to the outside of the package or placed directly into the package, for example.

SUMMARY OF INVENTION

The present invention is directed towards an apparatus for printing a label and applying the label inner surface to an item, such as a package or envelope. Generally, the apparatus is used with a label or multiple labels each having an outer and inner surface and adhesive applied to a portion of the inner surface. The apparatus comprises a mounting means for rotatably mounting the label stock and a transfer means for positioning the inner surface of a label from the stock to adjacent to at least one print means and then to a separation edge where the label is separated from a next label and, when applicable, from its backing. The apparatus further includes an applicator for accepting the label from the separation edge and applying the label to an item. In essence, this apparatus may be used for printing any type of data onto one or two surfaces of a label and applying it to a desired object.

In an embodiment of the invention, a mounting means contains a roll or supply of labels. The mounting means allows the labels to be dispensed from the roll or label source and fed through the apparatus. Preferably, the mounting means rotates and is a spindle, wheel or roll, such as a rotatable spindle. The labels preferably have an outer surface and an inner surface and at least two operative sides or edges about which adhesive is applied on the inner surface. The label stock may contain multiple labels each having an end that abuts or attaches to an end of an adjacent label to comprise continuous label stock or that leaves a gap between it and an adjacent label. The gap may be only about millimeter long or up to about two inches or greater. In a preferred embodiment, the gap is one-eighth of an inch. Alternatively, individual labels may be used. The outer label surface is adapted to accept printing or to contain pre-printed data. Printing on this outer surface is common. Typically, the outer surface of a label contains print and the inner surface is coated, either completely or substantially, with an adhesive material that allows it to be affixed to an item. The present invention provides the unique capability and design of accepting print data on the inner surface in addition to the adhesive. Thus, the label can be affixed to an item at selected adhesive portions of the inner surface and data may be print on the remaining areas of the surface. When affixed to an item data print on the inner surface is hidden from view, until removed from the item. Moreover this print means can be used in combination with a print means that applies data on the outer label surface, thereby providing means for printing data onto two sides of a label and applying it to an item.

The present invention accepts at least two different types of labels: those with a protective backing and those without. For the former, the labels have a flexible continuous backing member or protective shield that removably attaches to and is positioned on the inner surface of the label with an adhesive layer. Preferably, the backing has a panel opening that exposes a portion of the inner surface of the label to accept print data. Other label designs useable with the present invention are linerless and do not require a backing material. The exposed portion of the inner surface to be printed does not contain adhesive. The adhesive for bonding the label to the package or container surface is on the perimeter of the inner surface of a label. It may run near to and parallel to two edges of a label, about one half of an inch to an inch from each edge, or the adhesive can be placed to completely surround the exposed printable surface or arranged in a pattern as the label application may require. For example, such labels are disclosed in U.S. patent application Ser. No. 09/948,882.

At least one print means is provided to print data on the inner surface of a label. A transfer means guides the labels from the mounting means rotatable spindle to the print means and positions one label at a time at an inner surface of the label adjacent to the print means thereby exposing a surface of the label to the print head. The exposed surface may include, for example, that under the open panel of the backing or, in the case of linerless labels, that portion of the surface that does not contain adhesive or, alternatively, the entire surface of the label depending upon the desired application. The print means prints data onto the exposed surface. While the data may include virtually anything, preferably, it can include packing slip information, such as contents identification and invoice information.

Optionally, an opposing outer surface of a label is exposed to a second print means having a print head that prints data thereon. Printing on the outer label surface may occur at the same time or sequentially with that of the first or inner surface. In an embodiment, this data includes shipping data such as the entity and location to whom an item will be sent.

Either print means may use a variety of print technologies; they may be the same or different from each other depending upon the desired end product. For example, the print technology may include a plate or drum type printer, such as a thermal, thermal transfer or laser printer means. An ink jet, dot matrix or impact printer may also be used. Preferably when drive rollers are used, the rollers are wider than the printing mechanism, unlike current rollers that typically have a length equal to the width of the print mechanism. This unique variation in length prevents the print means from contacting most, if any, of the protective backing or, in the case of linerless labels, the adhesive portion of the label. This facilitates printing. In a more preferred embodiment, rollers are about six inches and the printhead is about four inches in length.

Print technology that does not use a plate or drum can also be used, such as a typewriter. The print means and label stock should be selected to work effectively together. Depending upon the selected print mechanism, suitable labels may comprise of traditional paper stock or thermal, heat sensitive paper. Further, the transfer means adjusts to the selected print means to properly position the label surface about the print head. For instance, when used with an ink jet print mechanism, transfer means positions the surface slightly away from the jet dispenser, rather than touching the label paper such as is required when used with a laser printer. This difference may amount to only one thousandths of an inch, but can be significant. Thermal transfer uses the heat from the print head to transfer wax, resin or a combination of the two from a ribbon onto the surface of the label. Again, transfer means in the present invention adjusts to accommodate this print means. Generally, you are able to switch between these methods on either piece of label printing equipment. In a preferred embodiment, first print means uses a thermal transfer printing and second print means uses direct thermal printing.

The label or label stock is then transferred from the print means to a separation edge or peel point where a label can be separated from a next adjacent attached label. There may also be cutting means, such as a rotary cutter. The cutting means is preferably used with linerless labels provided by a continuous supply of labels, however, would not be required if the continuous labels are provided in desired shape and with perforations between each one. The separation means can be located about one quarter of an inch to an inch from the print mechanism or farther depending upon the application. Preferably it is located at a half an inch. When labels having backing are used, the label is also separated from its backing member about the separation edge. The label and backing are fed about an edge or roller such that the label is angled to separate from its backing. The transfer means moves the label about the point at an appropriate tension to ensure that it peels correctly and to avoid unnecessary or problematic slack in the backing, and yet not too tense to cause the label or backing to tear or sever prematurely. A cutter may be also used if necessary to separate one label from the next, if provided on backing without a gap or perforations between them.

Optionally, an air jet positioned near to this edge may blow air at an effective amount and rate to direct the label towards an applicator. An applicator accepts the separated label and applies it to a package. The applicator has an applicator pad with holes and a vacuum residing in the housing of the applicator to draw air inward through the holes. The vacuum further facilitates removal of the backing from the label and secures the label to applicator pad until it is applied to an item. The applicator pad holes are sized to accommodate the size and shape of particular labels used with the present invention, and thus the number of holes used may also vary. The air flow path is drawn from the pad by the vacuum. As the labels detach from the backing material, a rewind means collects the backing material about a backing roll or wheel.

After separation, linerless labels are fed on to the applicator pad the appropriate distance and then cut to size by a mechanical cutter or similar mechanism. Because such labels have no backing, the rewind means is unnecessary to this embodiment.

Computer software controls a stepper motor in the transfer means to index the labels forward stopping the labels and/or protective material from the first side from application to the package. Additionally, some form of label design software can be employed to generate the printing for the label. The software may use standardized programs known to those in the art to accept digital data for formatting and printing on labels data such as address, bar code etc. It may also require custom software programming to reformat the data from a customer's software program. In an embodiment, the computer software is operable via a control panel located adjacent to or on the print means mechanism. When mounted on the print means, control panel is situated such that it is rotatable by at least ninety degrees so that it may be tilted by the user for ease. This unique feature is especially useful because of the varying orientation of the printer means. The control panel may further communicate with sensors located on the apparatus to monitor the advancement of the label and to control the speed and amount of which labels are being fed into the printer and toward the applicator means. Generally, the electronic features, including printer means, applicator and vacuum of the present invention are contained within a housing or unit frame. The mounting means and initial part of transfer means are exterior to the unit frame as well as the control panel accessible to an operator.

It is an object of the present invention to provide an apparatus and an improved method for printing and applying labels to packages that contain data on two sides of the label. It is a further object to provide destination and shipping data on one side of the label and contents or packing slip data on the other side thereby eliminating the need to create the traditional pouch or envelope to separately contain the packing slip data and attach it to the package or to enclose such shipping data in the actual package. It further provides that the packing slip information is hidden from view. It is another object of this invention to provide an apparatus for printing and automatically applying labels using a continuously fed high speed means adaptable for use with a variety of printing means such as, for example, direct thermal, thermal transfer laser or ink jet printing.

Other features, aspects and advantages of the present invention will become better understood or apparent from a perusal of the following drawings, detailed description of the invention and appended claims.

BRIEF DESCRIPTION OF THE DRAWINGS

In the drawings which are attached hereto and made a part of this disclosure.

DETAILED DESCRIPTION OF THE DRAWINGS

Figure 1:
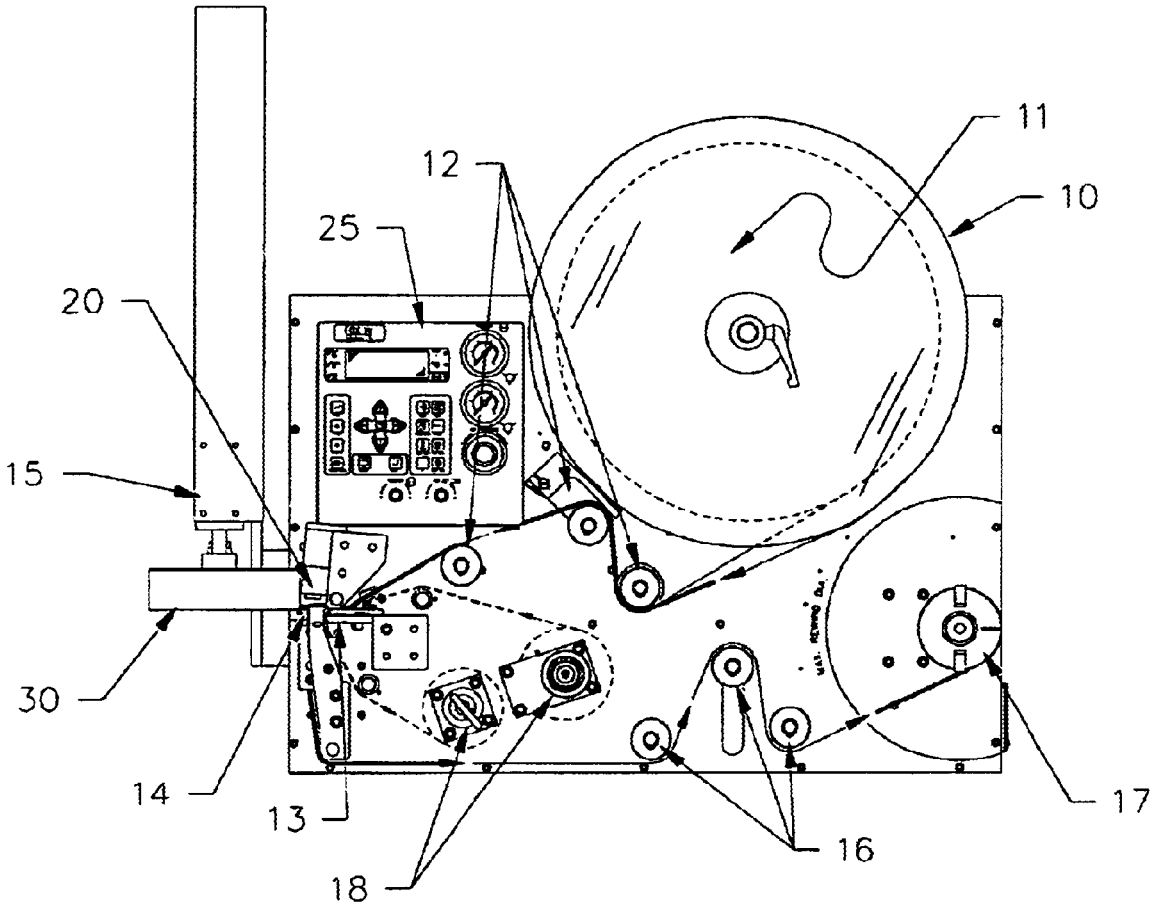
FIG. 1 illustrates a side elevation of an embodiment of the apparatus of the present invention.
Figure 2:
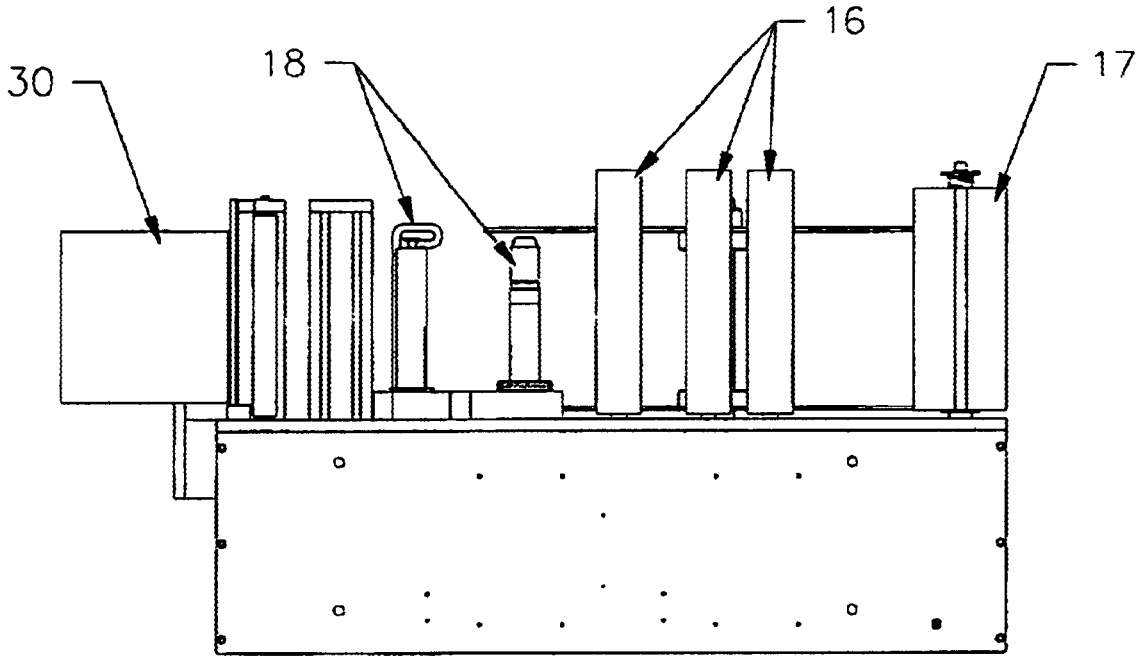
FIG. 2 illustrates a top view of an embodiment of the present invention.

In one embodiment of the present invention, by reference to FIG. 1, the apparatus comprises a rotatable spindle 10 for mounting a roll of continuous printable label stock 11 for printing labels. Label stock 11, preferably, comprises a plurality of labels wound about itself, generally known as linerless labels. Each label has at least two surfaces, an inner surface and an outer surface, and two ends. At least one end of a label is connected to an end of another label to comprise continuous printable label stock 11. In this embodiment, the label comprises a linerless printable paper, and thus does not require protective backing material. The label contains adhesive at a side or sides or completely about the perimeter surrounding an inner printable surface or arranged in a pattern as the application may require. In another embodiment, label stock 11 may comprise a plurality of labels on a flexible continuous backing member wherein each inner surface is removably connected to the backing member. As such, the individual labels need not be attached to adjacent label, rather a gap may exist between them. A transfer means 12 feeds the stock 11 to a print means 13 and sequentially positions the inner surface of each label on the stock adjacent to print means 13 which prints data on or to the inner surface of each label. The outer surface may be preprint with data or blank.

Figure 3:
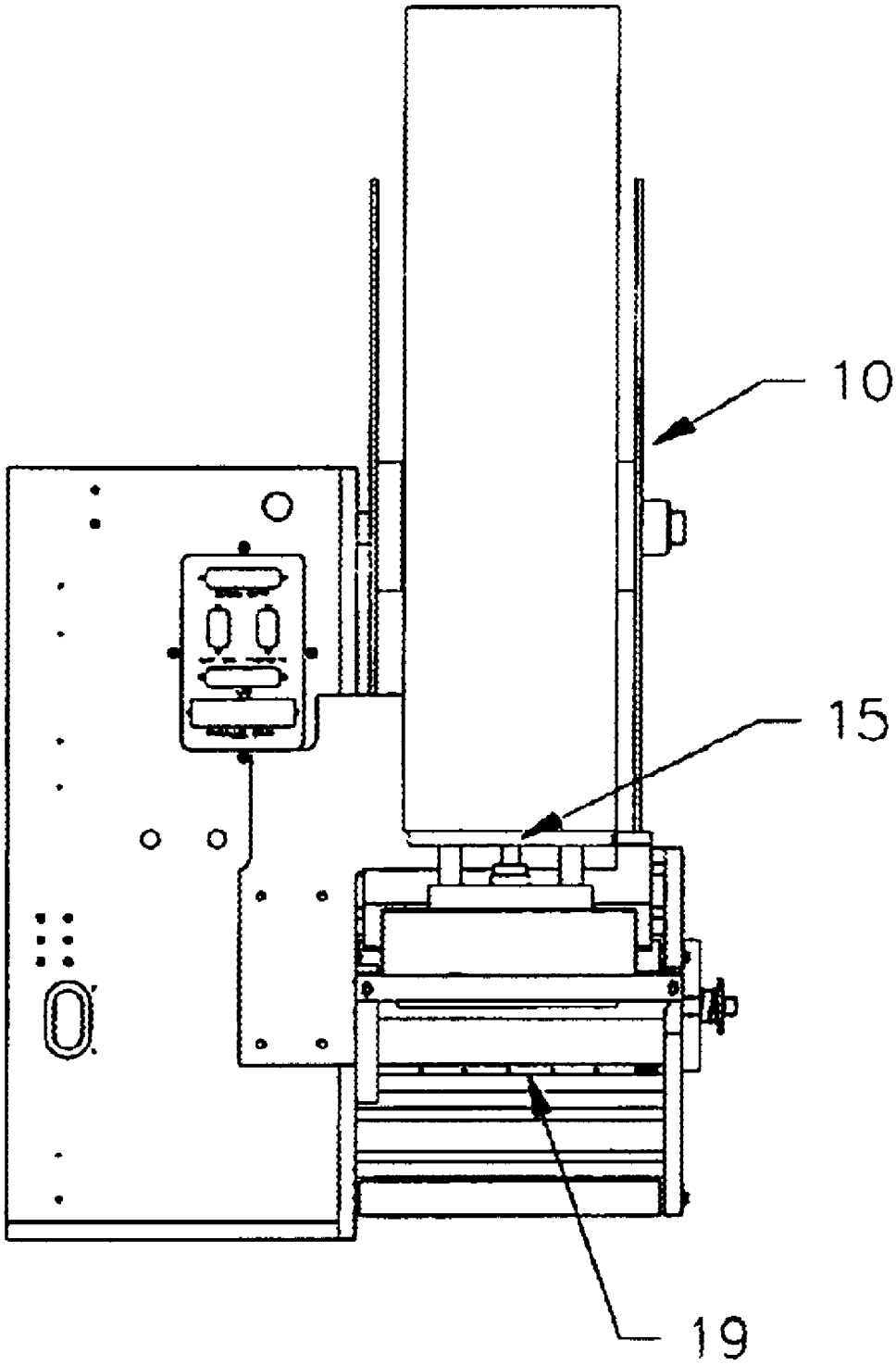
FIG. 3 illustrates a front side view of an embodiment of the present invention.

Transfer means 12 then feeds the stock 11 to a separation edge or peel point 14 for separating a label from an adjacent attached label and, for labels with backing, for separating its continuous backing member. At this point 14, the stock 11 are fed about an edge or roller roller angling a label to facilitate separation. Linerless labels may be automatically cut to length and are fed forward on to the applicator pad 30 an appropriate distance. An applicator 15 having an applicator pad 30 accepts the separated label and/or label from the backing member and applies the label to an item, such as an envelope or package. Optionally, as shown in FIG. 3, an air jet 19 is positioned near to separation edge 14 and blows air at an effective amount and rate to direct the label towards an applicator. Preferably the air jet is about two inches below the peel point and mounted on a center wall of the apparatus. The center wall structure may be used in connection and for holding the various elements of the invention. Applicator 15 accepts the separated label onto applicator pad 30 and applies it to a package. The applicator can further have a vacuum to facilitate removal of the backing from the label. As the labels detach from the backing material, a takeup means 16 collects the backing material about a rewind means 17 that comprises backing roll or wheel.

The transfer means 12 can comprise a tape or other conveyor line in conjunction with guide rollers and a motor for feeding the labels through the apparatus. Computer software controls a stepper motor in the transfer means for appropriately advancing the labels. Computer software may be embodied in and operable by control panel 25, for example. A take-up means 16 is provided when the invention is used with labels with liners to move separated backing from the separation edge 14 and collect it about a rewind means 17. In this way, take-up means 16 may also assist in removing backing from the label.

Preferably, the present invention further contains a second print means 20 for printing data to the outer surface of each label. Printing on the label outer surface may occur at the same time or sequentially with that of the first surface. In an embodiment, this second print means 20 prints data that includes shipping information, such as the entity and address of the recipient of the item to which the label is applied, and the first print means 13 prints information identifying the contents of the item such as the packing slip information. Moreover, in an embodiment, both print means 13 and 20 may be provided by one printer that is designed with a dual printhead configuration. One printhead may be on the top and another on the bottom. Alternatively, the print means may be designed to accept label stock twice, to print one side, then print the other side. Transfer means can be adjusted accordingly to accommodate transfer of labels to such print means.

In a preferred embodiment, the first print means 13 and/or second print means 20 includes a print head. First print means 13 and/or second print means 20 may use a variety of print technologies; they may be the same or different from each other depending upon the desired end product. For example, the print technology may include a plate or drum type printer, such as a thermal, thermal transfer or laser printer means. Preferably, the drive rollers are wider than the printing mechanism. In a more preferred embodiment, rollers are about six inches and the printhead is about four inches in length. An ink jet, dot matrix or impact printer may also be used. The printer means could use printer spools 18, for example. Print technology that does not use a plate or drum can also be used, such as a typewriter. Typically, the print means and label stock should work effectively together. Depending upon the selected print mechanism suitable labels may comprise of traditional paper stock or thermal, heat sensitive paper. Thermal transfer uses the heat from the print head to transfer wax, resin or a combination of the two from a ribbon onto the surface of the label. Generally, you are able to switch between these methods on either piece of label printing equipment. In a preferred embodiment, first print means 13 uses a-thermal transfer printing and second print means 20 uses direct thermal printing.

Rotatable spindle 10 contains a source or supply of continuous labels. These labels preferably have an outer surface adapted to accept printing or may comprise preprinted labels. The inner surface is designed to accept printing from the present invention. Preferably, the label comprises printable paper with a removable protective backing material covering a portion of one surface thereof. The backing material protects an adhesive layer that has been applied beneath the entirety or a part of the label. Removing the backing material at the peel point 14 exposes the adhesive coated label that subsequently is affixed to a package.

In use, the present invention prints data on the appropriate surface or surfaces of a label, removes backing from the paper, if any, thereby exposing the adhesive layer, and applies the label to an item. In this way, the packaging label can contain both shipping and invoice data on a single label that can be easily applied to a package and the packing slip information is hidden from view. Subsequently, the label is easily removed by the recipient whereby print paper may severed along weakening or perforation lines so as to provide a separable packaging label and reveal the invoice on the first or opposing surface.

While the foregoing has been set forth in considerable detail, the embodiments and preferences are presented for elucidation and not limitation. It will be appreciated from the specification that various modifications of the invention and combinations of elements, variations, equivalents, or improvements therein may be made by those skilled in the art, and are still within the scope of the invention as defined in the appended claims.

What is claimed is:

1. An apparatus for printing and applying a label to an item, comprising:

a. a rotatable spindle for rotatably mounting a source of continuous labels, each of said labels having an outer surface and an inner surface and two ends, each of said labels being connected by at least one of said ends to an end of at least one other label;

b. a first print means to print data on said inner surface of a label;

c. a second print means to print data on said outer surface of said label; either simultaneously or sequentially with the printing of said inner surface, d. a transfer means for positioning said inner surface adjacent to said first print means from said source to a separation edge to detach said label edge from at least one connected label; and e. an applicator for accepting said label and applying said label to an item positioned adjacent a separation edge.

2. An apparatus for printing and applying a label to an item, comprising:

a. a rotatable spindle for rotatably mounting a source of continuous labels, each of said labels positioned on a flexible continuous backing member, said label having an outer surface and an inner surface and two ends, said inner surface being removably attached to said backing;

b. a first print means to print data on said inner surface of a label;

c. a second print means to print data on said outer surface of said label; either simultaneously or sequentially with the printing of said inner surface, d. a transfer means for positioning said inner surface adjacent to said first print means from said source to a separation edge for separating said label from said backing;

e. an applicator for accepting said label from said backing and applying said label to an item positioned adjacent a separation edge; and f. a take-up means for removing said separated backing from a separation edge to a rewind means, said take up means being controlled by said transfer means.

3. An apparatus for printing and applying a label to an item as set forth in claim 1 or 2 further including a control means for controlling said transfer means and print means, said control means including data collection interface.

4. An apparatus for printing and applying a label to an item, comprising:

a. a mount for dispensing a source of labels, each of said labels having an outer surface and inner surface and two ends;

b. a first print means to print data on said inner surface of a label;

c. a second print means to print data on said outer surface of said label;

d. a transfer means for positioning said inner surface adjacent to said first print means and to said second print means from said source; and e. an applicator for accepting said label and applying said label to an item.

5. an apparatus for printing and applying a label to an item as set forth in claim 4, wherein said mount is capable of dispensing a roll or other supply of labels.

6. An apparatus for printing and applying a label to an item as set forth in claim 4, wherein said amount includes a spindle, wheel or roll.

7. An apparatus for printing and applying a label to an item as set forth in claim 4 wherein said source of labels includes a roll or other source supply of label stock, or individual labels.

8. An apparatus for printing and applying a label to an item as set forth in claim 4 wherein each of said labels is connected by at least one of said ends to an end of at least one other label or being positioned on a continuous backing member.

9. An apparatus for printing and applying a label to an item as set forth in claim 4 wherein said transfer means positioning said inner or outer printed surfaces adjacent to said first or second print means, said print source to a separation edge, to detach said label edge from at least one connected label or from a backing member.

10. An apparatus for printing and applying a label to an item as set forth in claims 1,2 or wherein said second print means prints data on said outer surface at the same time or sequentially with said first print means printing data.

* * * * *